United States Patent [19]

Orlosky et al.

[11] Patent Number: 4,934,636

[45] Date of Patent: Jun. 19, 1990

[54] CONTAINMENT DEVICE FOR ITEMS OF IRREGULAR SHAPE OR CONFIGURATION

[75] Inventors: Donald P. Orlosky, Timberlake, Ohio; Robert A. Kellogg, Butler, Pa.

[73] Assignee: Axia, Incorporated, Oak Brook, Ill.

[21] Appl. No.: 156,318

[22] Filed: Feb. 16, 1988

[51] Int. Cl.[5] ..... B65B 67/12

[52] U.S. Cl. ..... 248/95; 211/194

[58] Field of Search ..... 248/95, 97, 99; 211/194, 49.1; 108/53.1, 53.5; 206/506, 508

[56] References Cited

U.S. PATENT DOCUMENTS

| | | | |
|---|---|---|---|
| 1,057,240 | 3/1913 | Hildreth | 248/95 |
| 2,062,023 | 11/1936 | Gosselin | 248/99 |
| 2,357,157 | 4/1942 | Wood | 242/78 |
| 2,801,752 | 12/1954 | Jakubowski | 211/49 |
| 3,503,519 | 1/1968 | Jay | 211/60 |
| 3,565,018 | 2/1971 | Jay | 108/53 |
| 3,762,343 | 10/1973 | Thacker | 108/53 |
| 3,806,146 | 4/1974 | Shaw | 248/95 X |
| 3,844,600 | 10/1973 | Jay | 294/67 D |
| 4,588,154 | 5/1986 | Basore | 248/97 X |
| 4,685,567 | 8/1987 | Webb | 205/506 |
| 4,723,740 | 2/1988 | Courtemanche et al. | 248/95 |

OTHER PUBLICATIONS

"Inside Warehousing Distribution", May 1988, Transportation and Distribution, pp. 63, 64 and 66.

Miami Industrial Trucks 1988, Spring/Summer, p. 164.

*Primary Examiner*—Reinaldo P. Machado

*Assistant Examiner*—Sarah A. Lechok

*Attorney, Agent, or Firm*—Kirkland & Ellis

[57] ABSTRACT

A storage bag which is supported by and maintained upon a stackable storage rack is disclosed for handling, storing and moving items of irregular shape or configuration in a manufacturing, shipping, warehousing, or receiving facility. In the preferred embodiment of the present invention, the storage bag is hung on a device that is supported by the storage rack. This hanging device can be moved from storage rack to storage rack and can be loaded or unloaded from its top. The use of this hanging device permits the bag to be filled while in place in the storage rack and, therefore, easily moved with a forklift. In an alternative embodiment of the present invention, the storage bag is supported by the storage rack at its top and lower portions by strapping material to maintain shape and front retention devices to contain the contents. The bag serves as a containment device for small or irregular cartons or irregular items that are not of an even size such that they can be stacked in a way to maintain the integrity of the stack.

5 Claims, 5 Drawing Sheets

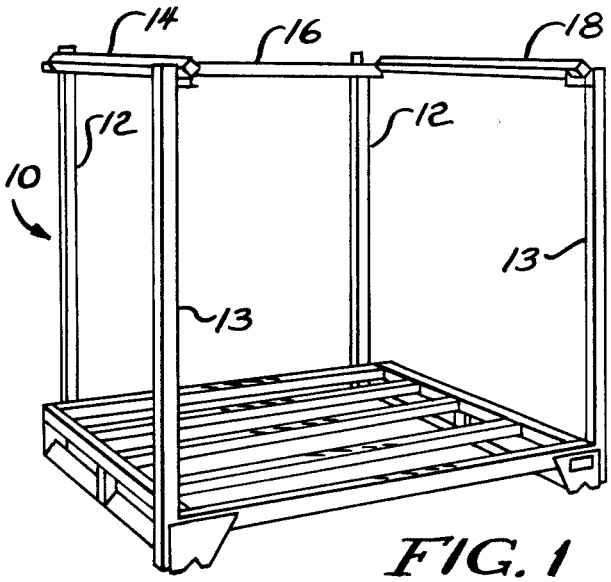
FIG. 1
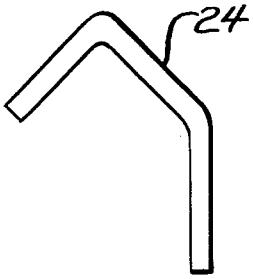
FIG. 4
FIG. 2
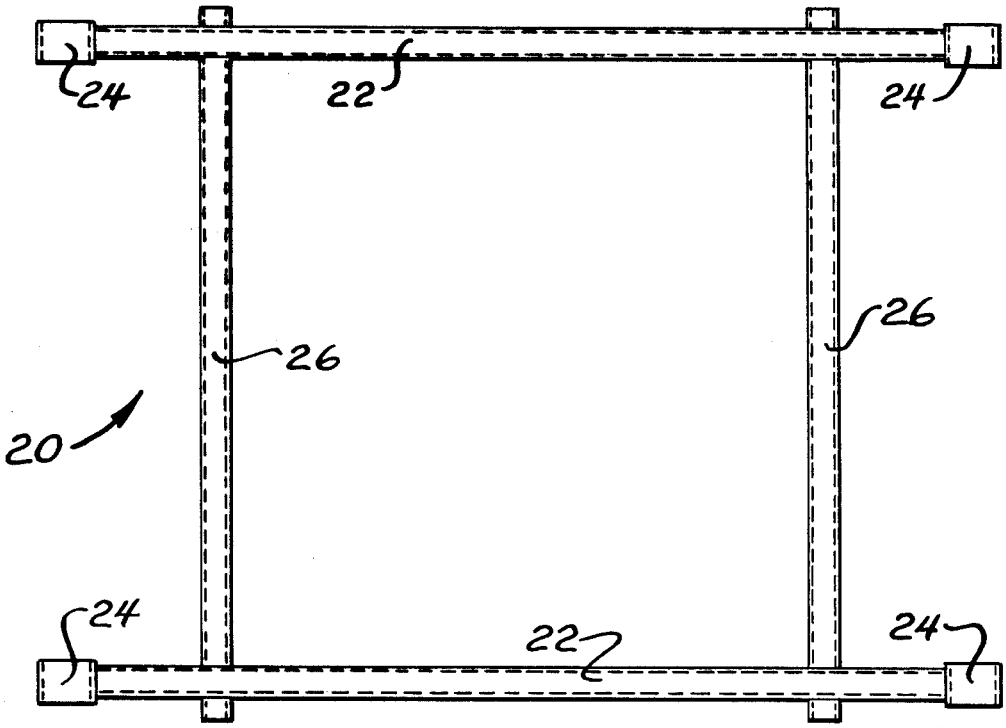
FIG. 3
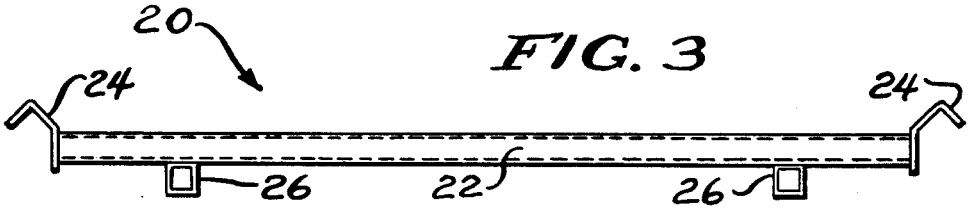

CONTAINMENT DEVICE FOR ITEMS OF IRREGULAR SHAPE OR CONFIGURATION

BACKGROUND OF THE INVENTION

1. Field of the Invention

This invention relates to containment devices and, more specifically, to devices for handling, storing and moving items of irregular shape or configuration in a manufacturing, shipping, warehousing or receiving facility.

2. Description of the Prior Art

It has become quite prevalent in industrial facilities and in the warehousing and material handling industry to employ the use of stackable storage racks of a wide variety of types. These stackable storage racks, some of which are nestable, function to store a plurality of given items while permitting vertical stacking of one storage rack upon another. In this manner, the stackable storage racks conserve warehouse space because a minimum of floor space is utilized when a series of such racks are in vertical orientation, increase product protection and improve labor efficiency.

Exemplary of such nestable and stackable storage racks are Nestainers®, commercially available from the Nestaway division of Axia, Inc. and described in detail in U.S. Pat. No. 3,762,343. Another such stackable, albeit non-nestable, storage rack is disclosed in U.S. Pat. No. 2,801,752 wherein a modular stacking unit accommodates the storage of bar stock and other similar elongated materials. Similarly, U.S. Pat. No. 2,357,157, discloses a material handling and storage hopper which facilitates the storage and handling of small parts. Still another example of such units is disclosed in U.S. Pat. No. 3,503,519, which again represents a structure for storing and handling elongated flexible stock and permits the vertical storage of a plurality of bins containing such materials. U.S. Pat. No. 3,565,018 shows a modular storage rack which accommodates vertical stacking of a plurality of racks with each of the racks having a full complement of the units or items to be stored thereon while still permitting vertical stacking thereof.

These prior art stackable storage racks, however, have numerous disadvantages when used to store bulk product or material and especially bulk storage bags. For example, bulk bags, by their very nature, do not keep their basic shape. With the mixture of bulk powders, chemicals, resins, etc., the profile of the bulk bag is continually shifting and changing in configuration. Such changes in configuration inhibit efficient handling of bulk bags by creating problems in selecting, lifting and moving. Moreover, the settling of materials in the bulk bag also restricts the emptying of the bags at various hoppers or dumping stations. Prior art solutions to these problems are both expensive and difficult to use.

The prior art stackable storage racks also have numerous disadvantages when used to store small cartons or irregular items (such as stuffed animals, small tires, etc.) that are not of an even size such that they can be stacked in a way to maintain the integrity of the stack. Indeed, such cartons or irregular items tend to fall out the sides of the storage rack not only when the rack is stationary, but especially when the rack is being moved by forklift. Prior art solutions to these problems, such as side and rear vertical retention poles, cross-braces, and horizontal straps or braces, also are expensive, sometimes non-reusable and difficult or time consuming to install and use. Moreover, such devices must be removed in order for nestable storage racks to be nestable.

Thus, it is a principal object to the present invention to combine the benefits of a bulk storage bag and a stackable storage rack into one unit.

It is another object of the present invention to provide a more effective and efficient method of handling, storing and moving bulk product or material in a manufacturing, shipping, receiving or warehousing facility.

It is another object of the present invention to enhance the emptying of bulk bags at various hoppers or dumping stations.

It is another object of the present invention to improve the overall loading and unloading of bulk bags in such a way that the bags will be properly positioned to be filled or emptied as required.

It is another object of the present invention to provide a containment device for items of irregular shape or configuration such that they can be stacked in a way to maintain the integrity of the stack.

SUMMARY OF THE INVENTION

The above and other objects of the present invention are achieved by a storage bag which is supported by and maintained upon a stackable storage rack. In the preferred embodiment of the present invention, the storage bag is hung on a device that is supported by the storage rack. The hanger device can be moved from storage rack to storage rack and the storage bag can be loaded from its top or unloaded from its bottom. The use of this hanging device controls the vertical alignment of the bulk bag; assists in lifting and moving the bulk bag to selected locations and improves the overall loading and unloading characteristics of the bag in such a way that the bags will be properly positioned to be filled or emptied as required.

In an alternative embodiment of the present invention, the storage bag is supported by the storage rack at its top and lower portions by strapping material to maintain shape and front retention devices to contain the contents.

This configuration also controls the vertical alignment of the bulk bag, assists in lifting and moving the storage rack to selected locations and improves the overall loading and unloading characteristics of the bag.

BRIEF DESCRIPTION OF THE DRAWINGS

The above and other objects of the present invention may be understood best by studying the following detailed description, which description references the accompanying drawings, in which:

FIG. 1 is a perspective view of one type of prior art nestable and stackable storage rack:

FIG. 2 is a top view of the preferred embodiment of the present invention;

FIG. 3 is a front view of the preferred embodiment of the present invention;

FIG. 4 a side view of the hanger clip of the preferred embodiment of the present invention;

DETAILED DESCRIPTION OF THE PREFERRED EMBODIMENT

Figure 5:
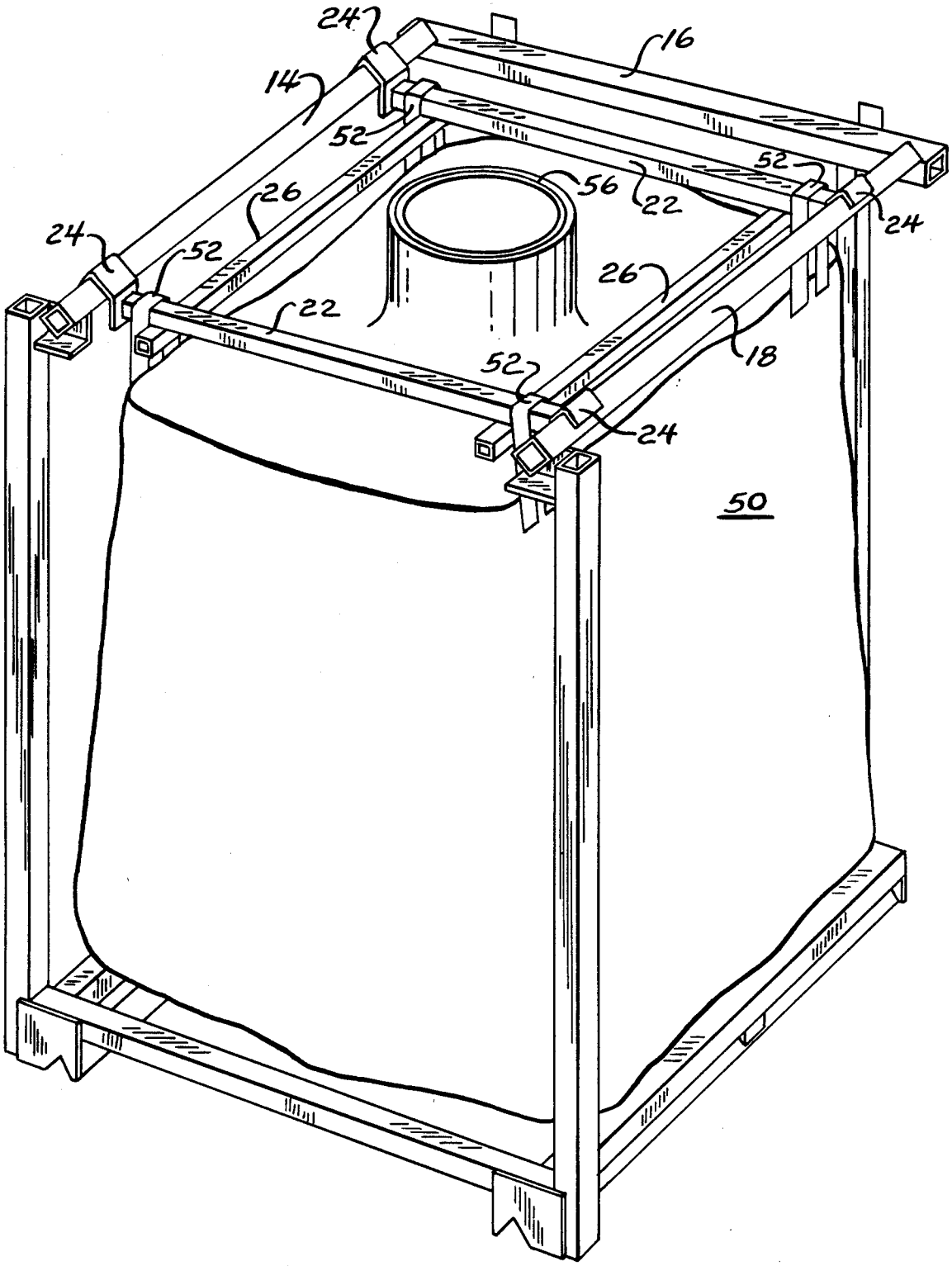
FIG. 5 is a perspective view of the preferred embodiment of the present invention as used with the storage rack shown in FIG. 1.

With reference to FIG. 1, a prior art nestable and stackable storage rack 10 is shown. Storage rack 10 comprises four parallel vertical columnar corner posts located at the four corners generally of a rectangle. Two corner posts 12 at the rear of the container are spaced closer than the two posts 13 at the front of the container so that the rear posts may pass through and between the front posts of a like container when nesting two similar containers. Storage rack 10 further comprises three rigid top frame members 14, 16, and 18 extending along the sides and the rear of the container at the top and are rigidly connected to the corner posts. Other details concerning the structure and construction of this prior art storage rack are contained in U.S. Pat. No. 3,762,343 entitled "End-Nesting Containers Adapted to Stack" and assigned to the assignee herein. While the description of the preferred and alternative embodiments is made with reference to this particular prior art storage rack, it should be understood that the present invention can be used with other types of prior art nestable and non-nestable storage racks.

Hanging device 20 of the present invention is shown from the top in FIG. 2 and from the front in FIG. 3. Hanging device 20 comprises two support bars 22, the ends of which contain hanger clips 24, and guide separator 26 which are rigidly connected to support bars 22 at such point as to provide maximum support. The precise point at which guide separator bars 26 are rigidly connected to support bars 22 is determined by the size of the bag and the configuration and dimensions of the particular storage rack 10 that is employed with hanging device 20. In the preferred embodiment, guide separator bars 26 are metal and hollow so as to provide the required strength without excessive weight, thereby facilitating the manual movement of hanging device 20. Guide separator bars 26 also are welded in the preferred embodiment so as to contend with the forces which are transmitted by load shift. The length of hanging bars 22 is that length necessary to allow hanger clip 24 to rest upon top frame members 14 and 18 of storage device 10. Hanger clips 24, as seen from the front in FIG. 3 and FIG. 4, are here shown as inverted V-shape members, however, it should be understood that numerous variations could be made that would allow hanging device 20 to be used with storage device 10.

Storage bag 50 is commercially available from B.A.G. Corporation. Each corner of storage bag 50 has commercially sewn/stitched suspension strap 52 which fits over support bars 22 and suspends storage bag 50 as shown in FIG. 5. Strap 52 is manually looped over hanging bars 22. Storage bag 50 is thus located on hanging device 20 which is then positioned on storage rack 10, preferably with a forklift truck or overhead crane. Once hanging device 20 is in place on storage rack 10, storage bag 50 can be suspended from hanging device 20 as shown in FIG. 5. Additional storage racks can then be stacked upon storage rack 10.

Storage bag 50 can be filled while suspended from hanging device 20. Filler spout 56 on storage bag 50 encompasses the funnel shaped loading device (not shown). A drawstring or cord (not shown) may be employed to secure or reinforce this attachment. Storage bag 50 also may be closed in a similar manner. Filled storage bag 50 generally is designed to rest on the deck of storage rack 10. In this manner, storage rack 10 can be easily handled, stacked and moved without having to remove storage bag 50.

Figure 6:
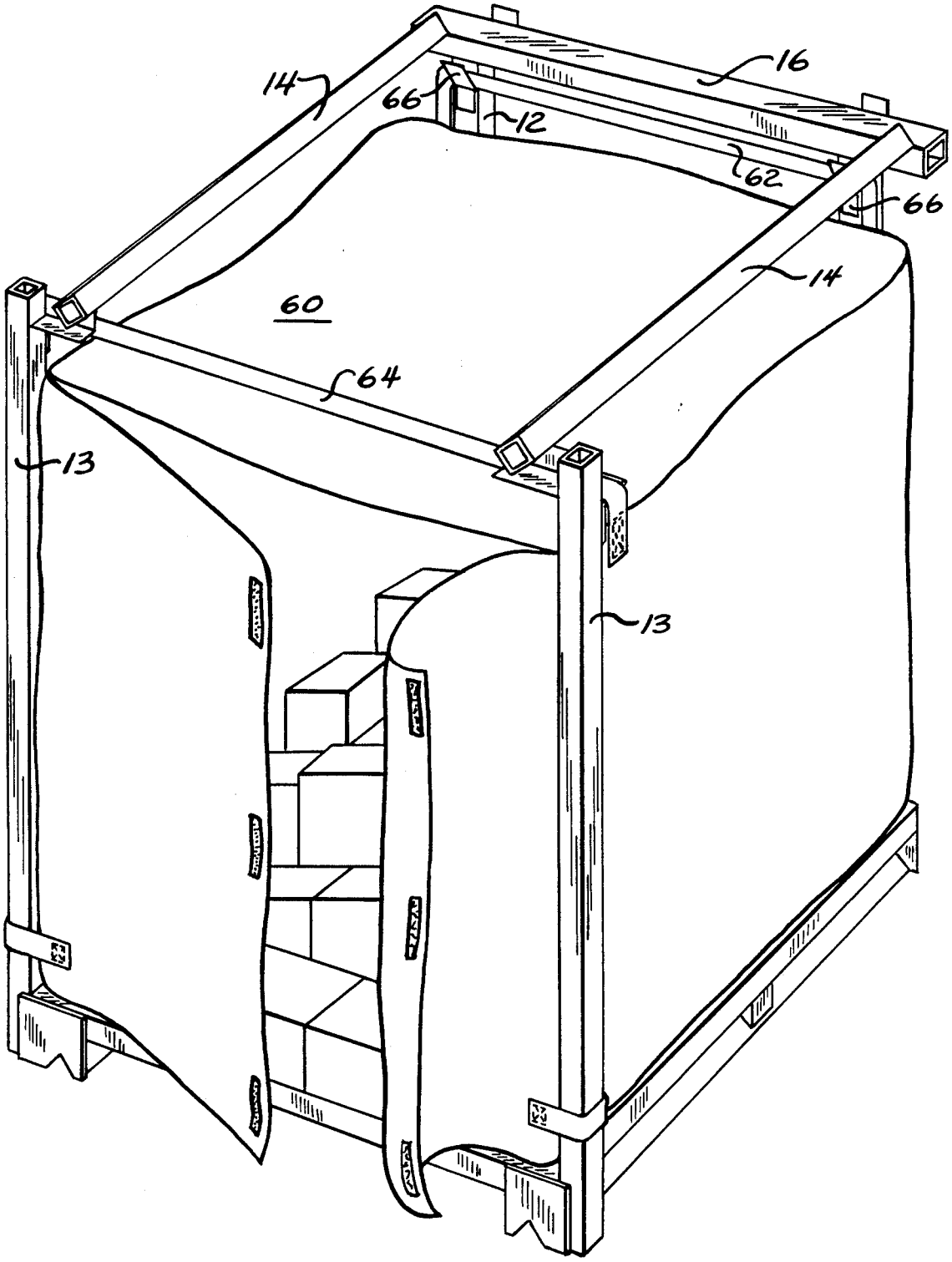
FIG. 6 is a perspective view of a first alternative embodiment of the present invention.
Figure 7:
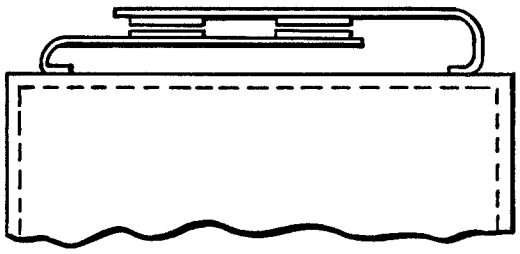
FIG. 7 is a partial top view of the storage bag used with the first alternative embodiment of the present invention.
Figure 8:
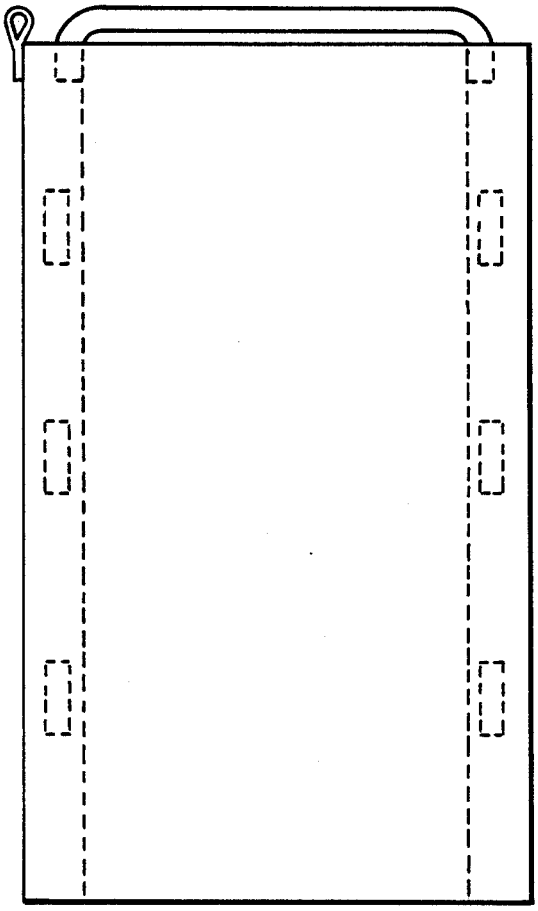
FIG. 8 is a front view of the storage bag used with the first alternative embodiment of the present invention.
Figure 9:
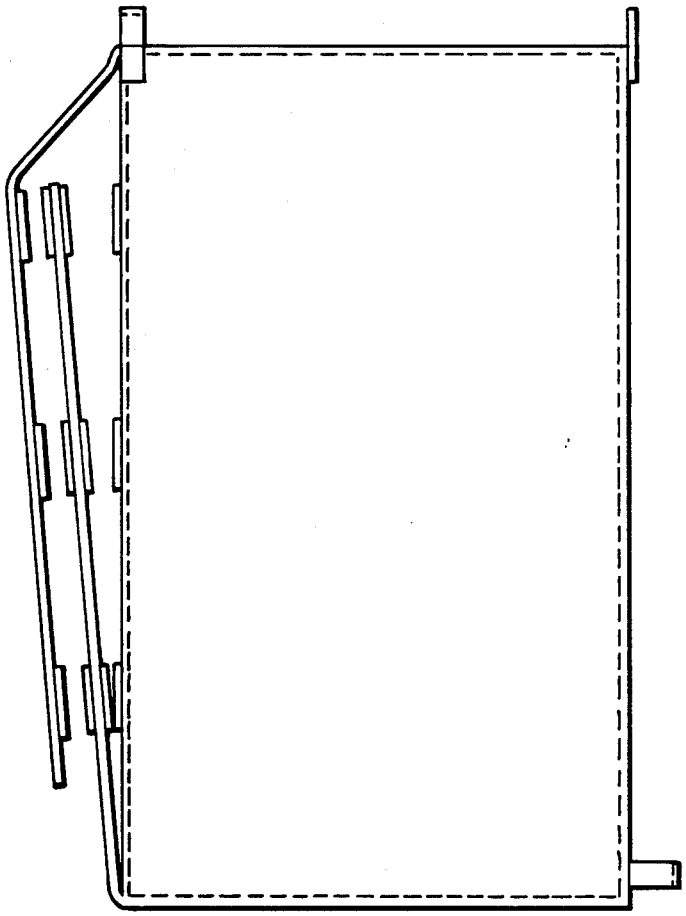
FIG. 9 is a side view of the storage bag used with the first alternative embodiment of the present invention.
Figure 10A:
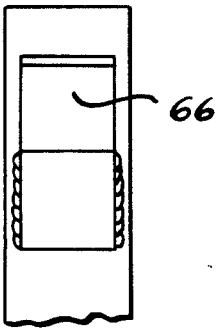
FIGS. 10A and 10B are front and side views respectively of the hanger clip used with the first alternative embodiment of the present invention.
Figure 10B:
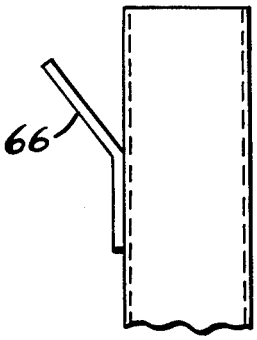

In an alternative embodiment of the present invention, storage bag 60 is suspended directly from storage rack 10 without the need for or use of hanging device 20 as shown in FIG. 6. In this alternative embodiment, two straps 62 and 64 are attached, preferably by stitching, to storage bag 60 and placed over hanger clips 66. Hanger clips 66, shown from the front and side in FIGS. 10A and 10B, are rigidly attached, preferably by welding, to the inside of corner posts 12 and 13 of storage rack 10. Once suspended from hanger clips 66, storage bag 60 can be easily loaded and unloaded from the front. Front loading has numerous advantages when used to store small cartons or irregular items that are not of an even size such that they can be stacked in such a way to maintain the integrity of the stack. A variety of methods could be employed to close the front of storage bag 60, including velcro ®enclosure straps as shown in FIGS. 6–9. As in the preferred embodiment, the weight of storage bag 60 is not entirely upon the base of storage rack 10, with the forces related thereto evenly distributed through the hanger clips and rack decking. This configuration controls the vertical alignment of the bag, assists in lifting and moving the storage rack and improves the overall loading and unloading characteristics of the bag.

It should be recognized by one of ordinary skill in the art that storage bag 50 also could be suspended directly from storage rack 10 without the need for or use of hanging device 20. However, minor modifications would be necessary to storage rack 10.

It should be noted that the above description and drawings are illustrative only, as one of ordinary skill in the art would recognize that various modifications could be made without departing from the spirit or scope of the present invention, which is to be limited only by the following claims.

What is claimed is:

1. A containment device for items of irregular shape or configuration comprising:

a stackable storage rack having four parallel vertical columnar posts located generally at the four corners of a rectangle;

retention means for retaining said items of irregular shape or configuration in said storage rack;

suspension means for suspending said retention means from said storage rack thereby controlling the vertical alignment of said retention means, assisting in lifting and moving said storage rack and improving the loading and unloading characteristics of said retention means wherein said suspension means further comprises: hanging means for hanging said retention means therefrom, said hanging means comprising a pair of support bars rigidly and perpendicularly connected to a pair of separator bars and four clips attached to each end of said support bars for hanging said suspension means from said containment device; and closure means for closing said retention means thereby preventing said items of irregular shape or configuration from falling out of said retention means when said storage rack is lifted or moved.

2. A containment device as claimed in claim 1 wherein said retention means is a bag.

3. A containment device as claimed in claim 1 wherein said storage rack further comprises:

at least 2 rigid members extending along the sides of said storage rack at its top and rigidly connected to said corner posts.

4. A containment device as claimed in claim 3 wherein said retention means further comprises:

four loops stitchedly attached to the four corners of said retention means.

5. A containment device for items of irregular shape or configuration comprising:

a stackable storage rack having four parallel vertical columnar posts located generally at the four corners of a rectangle;

retention means for retaining said items of irregular configuration in said storage rack and wherein said retention means further comprises a pair of loops stitchedly attached to opposite sides of said retention means;

suspension means for suspending said retention means from said storage rack thereby controlling the vertical alignment of said retention means, assisting in lifting and moving said storage rack and improving the loading and unloading characteristics of said retention means wherein said suspension means further comprises:

four hooks rigidly attached to said vertical columnar posts, said hooks being adapted to receive said loops of said retention means.

* * * * *